United States Patent [19]

Beales

[11] Patent Number: 5,044,549

[45] Date of Patent: Sep. 3, 1991

[54] CLAMSHELL TYPE CARTON

[75] Inventor: Jonathan Beales, Philadelphia, Pa.

[73] Assignee: International Paper Company, Purchase, N.Y.

[21] Appl. No.: 538,450

[22] Filed: Jun. 15, 1990

[51] Int. Cl.[5] ..... B65D 5/20

[52] U.S. Cl. ..... 229/125.27; 229/114; 229/125.29; 229/146; 229/148

[58] Field of Search ..... 229/114, 125.27, 125.29, 229/146, 148, 160.2

[56] References Cited

U.S. PATENT DOCUMENTS

| | | | |
|---|---|---|---|
| 2,393,277 | 1/1946 | Beardsell | 229/160.2 |
| 2,839,236 | 6/1958 | Dunning | 229/148 |
| 3,178,090 | 4/1965 | Connell | 229/160.2 |
| 3,195,798 | 7/1965 | Wilson | 229/125.29 |
| 4,516,718 | 5/1985 | Forbes, Jr. | 229/148 |
| 4,848,648 | 7/1989 | Fisman | 229/114 |
| 4,930,681 | 6/1990 | Fultz et al. | 229/125.29 |

*Primary Examiner*—Gary E. Elkins

*Attorney, Agent, or Firm*—Michael J. Doyle; Walt Thomas Zielinski

[57] ABSTRACT

A clamshell carton formed from two integral blanks of sheet material. The front wall of the upper clamshell carries a latching aperture. The front wall of the lower clamshell half carriers a latch release panel, the latter carrying a horizontally despaired latching tongue normally engaged in the latching aperture to maintain the clamshell in a closed configuration. The latch release panel is normally resiliently biased to maintain the latch tongue engaged. The front wall of the upper clamshell half is provided with a recess along a free edge, the recess permitting direct finger force to be applied to the latch release panel to open the carton by disengaging the latch.

4 Claims, 3 Drawing Sheets

FIG. 1
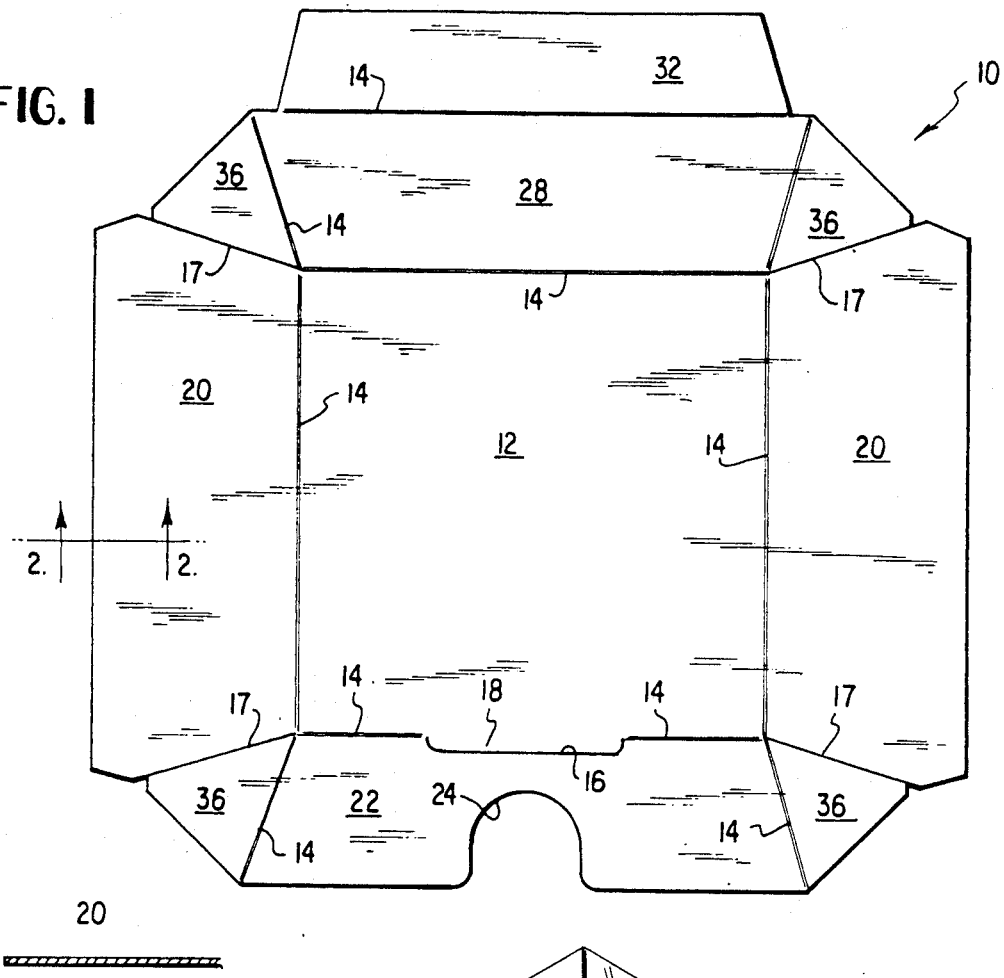
FIG. 2
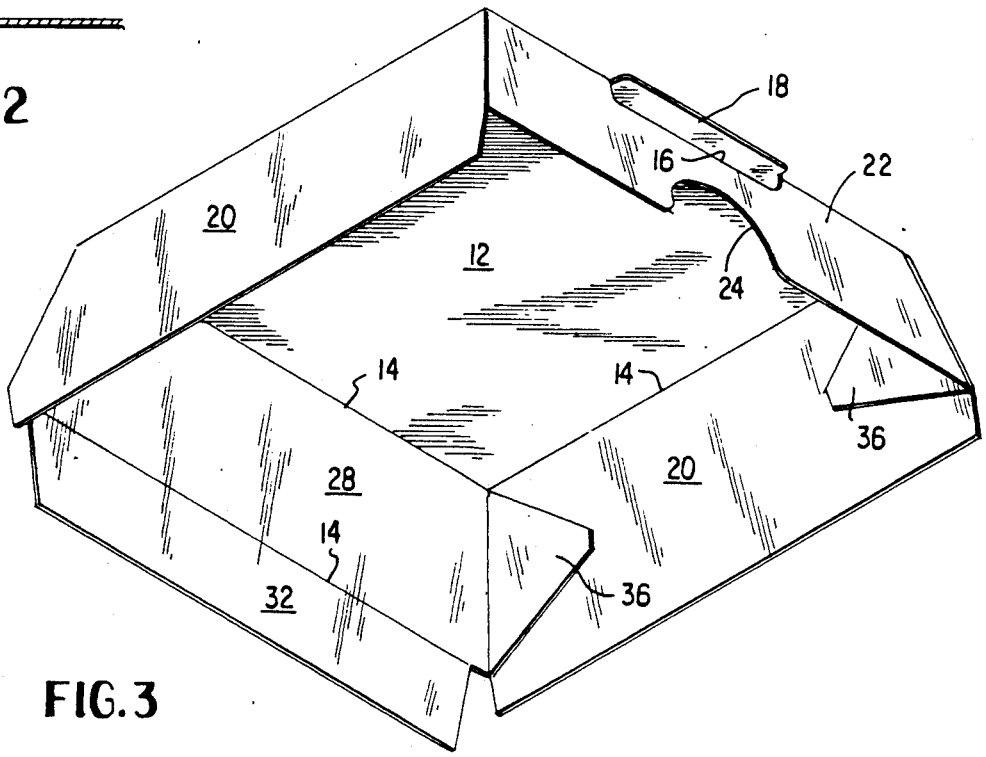
FIG. 3

FIG.4
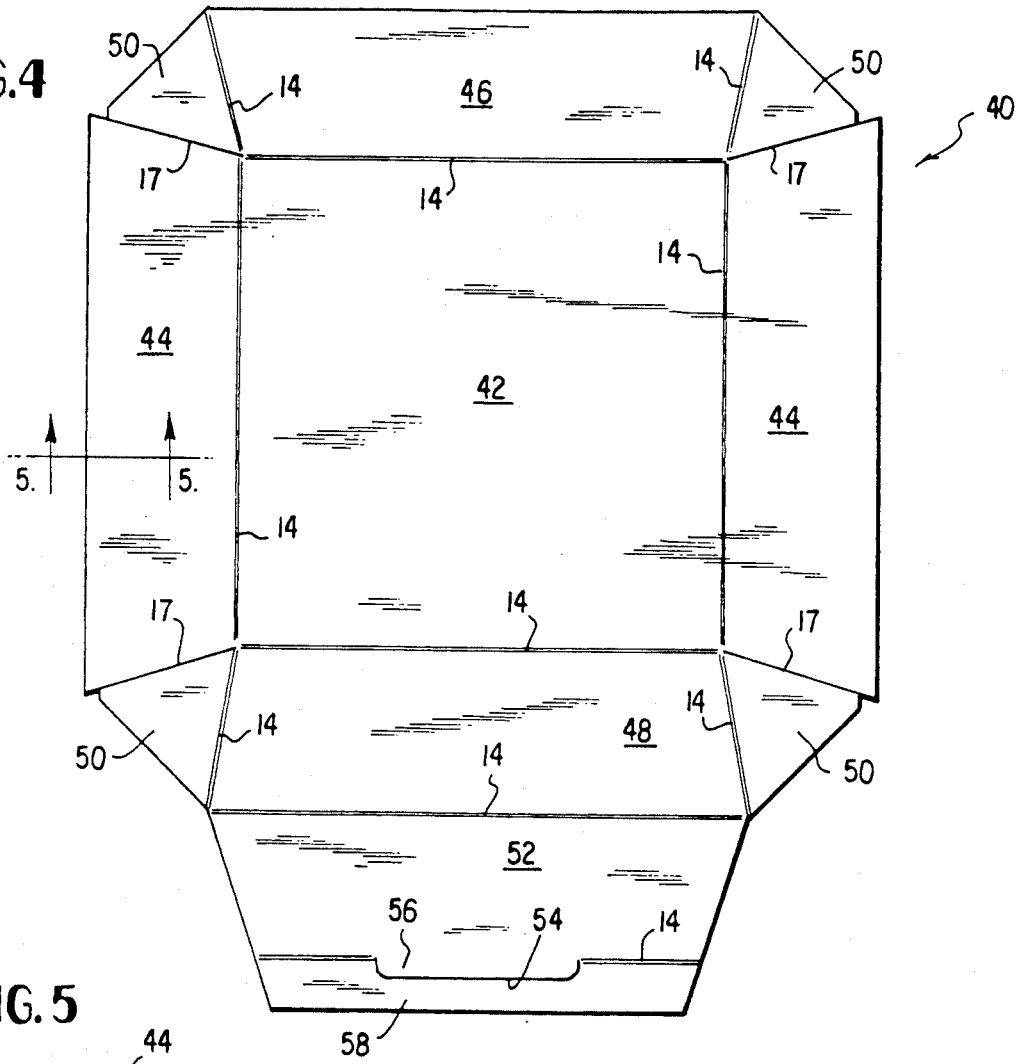
FIG. 5
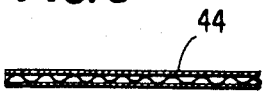
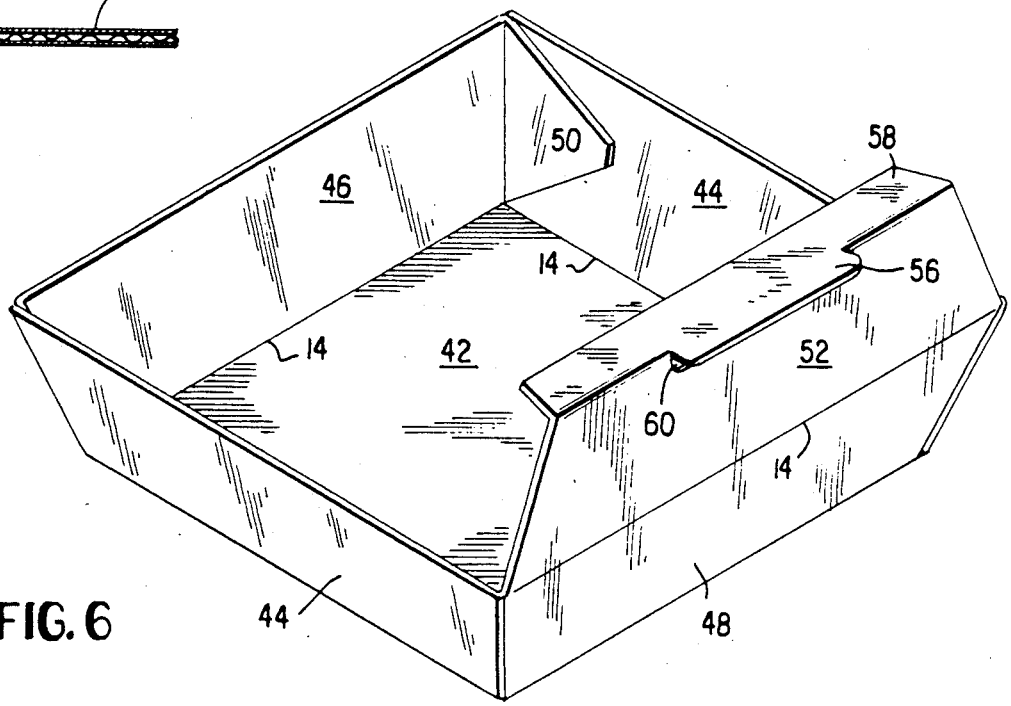
FIG. 6

CLAMSHELL TYPE CARTON

BACKGROUND OF THE INVENTION

This invention relates to containers and more particularly to clamshell type cartons.

Clamshell type cartons are frequently used in fast food restaurants wherein a hamburger, for example, will be placed in the open carton and the top then closed and latched. One example of such a carton is shown in U.S. Pat. 4,783,832 issued to Forbes. These cartons may be fashioned from a unitary blank of sheet material, such as paperboard or may be molded from a foamed plastic material, or fashioned from two separate blanks, with the blanks being adhesively joined to define a hinge between the top and bottom halves. While exhibiting utility as a temporary container for a food item between the time of its assembly to its delivery to the consumer, such cartons have not exhibited the desirable ease of unlatching. Further, by virtue of often encountered symmetry between the top and bottom carton halves, the consumer does not know which is the top of the container so that, when the latch is undone the sandwich or other food product is upside down.

SUMMARY OF THE INVENTION

According to the practice of this invention, an easily openable clamshell type container is provided so that a minimum of effort on the part of the consumer is required to positively open the container and gain access to its contents. Further, by virtue of the construction of this invention, the consumer is aware of which is the top of the container by merely inspecting the orientation of the latch release construction.

According to the invention the front wall of the top clamshell half is provided with an opening along its lower edge adapted to accommodate a finger of the user. This front wall overlies an upstanding latch carrying wall of the lower clamshell half, the latter wall including a latching tongue which normally fits inside a corresponding latch in the front wall of the top clamshell half. To open the container, it is only necessary for the consumer to push a finger against the latch release wall at its recessed portion and thereby disengage the latch tongue from the latching aperture.

Further according to the practice of the invention the bottom clamshell half is fashioned from corrugated paperboard, while the top half is fashioned from paperboard. The top clamshell half is provided with a hinge tongue or flap which is adhesively secured to a corresponding wall of the bottom clamshell half to thereby define a hinged clamshell type container.

BRIEF DESCRIPTION OF THE DRAWINGS

FIG. 1 is a plan view at a cut and scored paperboard blank for forming the top half of the carton.

FIG. 2 is a section taken along 2—2 of FIG. 1.

FIG. 3 is a perspective view of the top half of carton.

FIG. 4 is a plan view of a cut and scored corrugated blank for forming the bottom half of the carton FIG. 5 is a section taken along 5—5 of FIG. 1.

FIG. 6 is a perspective view of the bottom half of the carton.

DETAILED DESCRIPTION OF THE INVENTION

Figure 7:
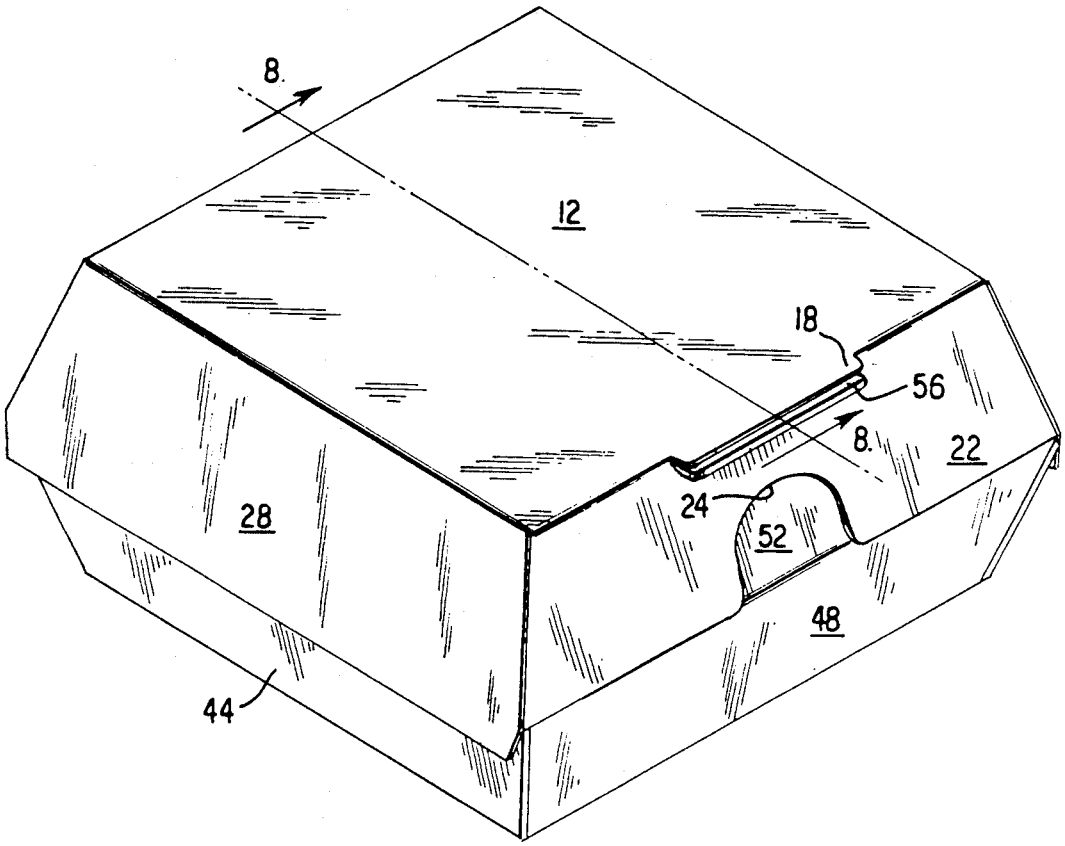
FIG. 7 is a perspective view of the carton in its closed, latched configuration.

Referring now to FIGS. 1—3 of the drawings, the numeral 10 denotes a blank for forming the top clamshell half. The blank is fashioned from paperboard, as shown at FIG. 2, or other stiff, bendable and resilient sheet material. The blank includes a central, rectangular portion 12 bounded on its four sides by scored fold lines 14 and generally rectangular panels 20, 22 and 28. The bottom fold line 14 is centrally interrupted by cut 16, curved at its ends, the cut 16 being laterally displaced downwardly from the remaining portions of lower fold line 14. Upon bending of lower panel 22 about hinge line 14, a tongue 18 is defined by virtue of this lateral displacement and the curves at the end of cut 16. Side wall forming panels 20 and rear wall forming panel 28 are also hinged along their respective fold lines 14 to central portion 12. Cut lines 17 separate the upper and lower ends of side wall forming panels 20 from panels 22 and 28. Upper panel 28 carries a pair of glue tabs 36, one at each end, also separated by a respective fold line 14 from panel 28. Front wall panel 22 is also proscribed with glue tabs 36 at its ends. A hinge forming panel 32 is foldibly secured along a fold line 14 to the upper portion of rear wall forming panel 28. Finger accommodating recess 24 is provided at the free edge of front panel 22.

FIG. 3 illustrates the top clamshell half formed from blank 10 after folding and gluing. Tabs 36 are glued to corresponding side panels 20, with tongue 18 projecting laterally outwardly, and coplanar with top panel 12. A latch opening is defined by space 19 (see FIG. 8) beneath tongue 18 and above cut line 17.

Referring now to FIGS. 4–6 of the drawings, a blank 40 is illustrated from which the lower clamshell half is fashioned. Blank 40 includes central rectangular portion 42 bounded by fold lines 14 and bounded on its right and left by side wall forming panels 44. Rear wall forming panel 46 is located at the top of central panel 42, while front wall forming panel 48 is at the bottom of panel 42, the panels joined along the scored fold lines 14. Glue tabs 50 are carried at the ends of panels 46 and 48 as illustrated. FIG. 5 illustrates the material of construction of the blank as of corrugated paperboard.

Latch panel 52 is secured by hinge line 14 to front wall panel 48, with panel 52 having a central cut line 54 centrally interrupting the lowermost fold line 14. Cut line 54, curved at its ends, defines latching tongue 56, as shown at FIG. 6, when upper endmost panel 58 is folded about 14. A latching aperture 60 is defined upon such folding. As before, end glue flaps 50 are secured to respective side panels 44 to hold the blank in the assembled position shown at FIG. 6.

Figure 8:
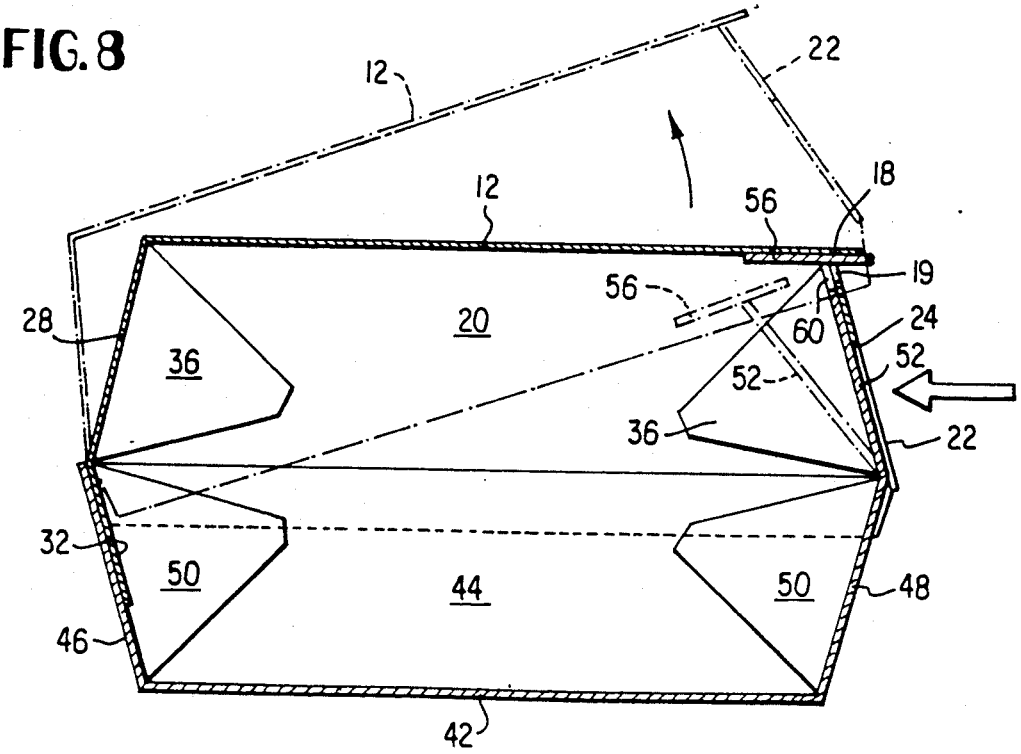
FIG. 8 is a section taken along 7—7 of FIG. 7, the unlatching of the top carton half being shown by phantom lines.

Referring now to FIGS. 7 and 8, FIG. 7 illustrates the carton in its closed, latched position. Latching tongue 56 extends through latching aperture 60, also as shown at FIG. 8. The phantom lines of FIG. 8 illustrate the action of the container upon unlatching. As shown by the arrow at FIG. 8 pointing to the left, the consumer pushes a fingertip against latching panel 52. This causes panel 52 to resiliently move counter clockwise and thereby move latch tongue 56 out of engagement with latch aperture 60. This permits the user to open the top half of the carton and gain access to its contents, typically a hamburger or other food product. Recess 24 permits direct pressing of a fingertip onto panel 52. By virtue of its inverted U shape, recess 24 further indicates the proper orientation of the carton, so that the consumer knows which is the top half.

I claim:

1. A clamshell type carton having an upper half and a lower half and having an easily releasable latch to hold the top clamshell half in a closed position relative to the bottom clamshell half, the top and bottom clamshell halves being hingedly secured together along a rear wall of the carton, the lower clamshell half having an upstanding front latch release panel having an upper portion and bendably secured to the lower clamshell half along a fold line, the upper portion of said latch release panel resiliently and bendably secured to a horizontally disposed latch tongue panel provided with a horizontally extending latch tongue, the upper clamshell half including a front wall having a latch aperture which releaseably receives said latch tongue in the closed position of the carton wherein the two said carton halves are closed together, said front wall of the upper clamshell half having a finger receiving recess, said recess located below said latch tongue, said upper clamshell half normally overlying said lower clamshell front latch release panel, whereby the finger receiving recess uncovers a portion of the lower clamshell front latch release panel to permit direct pressing, by a finger, of the front latch release panel to move the latch tongue out of the latch aperture upon bending of the latch release panel about said fold line.

2. The carton of claim 1 wherein the latch tongue is coplanar with the latch tongue panel.

3. The carton of claim 1 wherein the upper clamshell half is formed from a unitary blank of paperboard and wherein the lower clamshell half is formed from a unitary blank of corrugated paperboard.

4. The carton of claim 1 wherein said finger receiving recess is vertically aligned with said latch aperture.

* * * * *